US009400097B2

(12) United States Patent
Chen et al.

(10) Patent No.: US 9,400,097 B2
(45) Date of Patent: Jul. 26, 2016

(54) CONNECTOR, ELECTRONIC DEVICE AND ILLUMINATING DEVICE HAVING THE CONNECTOR

(71) Applicant: OSRAM GmbH, Munich (DE)

(72) Inventors: Xiaoyu Chen, Shenzhen Guangdong (CN); Hui Gui, Shenzhen Guangdong (CN); Junhua Zeng, Shenzhen Guangdong (CN); HongWei Zhang, Shenzhen Guangdong (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/370,969

(22) PCT Filed: Dec. 17, 2012

(86) PCT No.: PCT/EP2012/075748

§ 371 (c)(1),
(2) Date: Jul. 8, 2014

(87) PCT Pub. No.: WO2013/104490

PCT Pub. Date: Jul. 18, 2013

(65) Prior Publication Data

US 2014/0347869 A1 Nov. 27, 2014

(30) Foreign Application Priority Data

Jan. 10, 2012 (CN) ..... 2012 1 0006329

(51) Int. Cl.
*H01R 33/02* (2006.01)
*H01R 33/08* (2006.01)
(Continued)

(52) U.S. Cl.
CPC ..... *F21V 23/06* (2013.01); *F21V 19/001* (2013.01); *F21V 21/00* (2013.01); *F21V 23/00* (2013.01);
(Continued)

(58) Field of Classification Search
CPC ..... F21V 23/06; F21V 29/70; F21V 21/00; F21V 23/00; F21V 19/001; H01R 13/02; H01R 12/73; H01R 12/523; H01R 13/512; H01R 12/714
See application file for complete search history.

(56) References Cited

U.S. PATENT DOCUMENTS 4,760,495 A 7/1988 Till
5,435,734 A 7/1995 Chow
(Continued)

FOREIGN PATENT DOCUMENTS

CN 1689376 A 10/2005
CN 201925782 U 8/2011
(Continued)

OTHER PUBLICATIONS

English abstract of DE 4310440 A1 of Feb. 17, 1994.
(Continued)

*Primary Examiner* — Donald Raleigh
(74) *Attorney, Agent, or Firm* — Viering, Jentschura & Partner mbB

(57) ABSTRACT

A connector for electronic device includes a cylindrical body, an end cap formed at one end of the cylindrical body that includes a first section and a second section, wherein the first section is formed between the end cap and the second section, the end cap has a diameter bigger than that of the first section, and the first section has a diameter bigger than that of the second section, and a circumferential wall of the second section at least partially has threads, and an insulator circumferentially formed in one piece on the first section, wherein the end cap comprises a first electrical contact surface on an end surface facing the first section, and the first section includes a second electrical contact surface on an end surface facing the second section, and the first electrical contact surface and the second electrical contact surface are insulated from the first section.

11 Claims, 2 Drawing Sheets

(51) Int. Cl.

| | |
|---|---|
| ***F21V 19/00*** | (2006.01) |
| ***F21V 21/00*** | (2006.01) |
| ***F21V 23/06*** | (2006.01) |
| ***H01R 12/52*** | (2011.01) |
| ***H01R 12/73*** | (2011.01) |
| ***H01R 13/512*** | (2006.01) |
| ***F21V 23/00*** | (2015.01) |
| ***H01R 13/02*** | (2006.01) |
| ***F21V 29/70*** | (2015.01) |
| *H01R 12/71* | (2011.01) |

(52) U.S. Cl.

CPC ..... *F21V 29/70* (2015.01); *H01R 12/523* (2013.01); *H01R 12/73* (2013.01); *H01R 13/02* (2013.01); *H01R 13/512* (2013.01); *H01R 12/714* (2013.01)

(56) References Cited

U.S. PATENT DOCUMENTS

| | | | | |
|---|---|---|---|---|
| 2003/0232522 | A1 | 12/2003 | Buondelmonte et al. | |
| 2004/0066142 | A1 * | 4/2004 | Stimac et al. | 315/50 |
| 2004/0192084 | A1 | 9/2004 | Fronk | |
| 2010/0159738 | A1 * | 6/2010 | Nolting et al. | 439/428 |
| 2010/0327745 | A1 * | 12/2010 | Dassanayake et al. | 315/35 |
| 2011/0140136 | A1 | 6/2011 | Daily et al. | |

FOREIGN PATENT DOCUMENTS

| | | | | |
|---|---|---|---|---|
| DE | 3700661 | A1 | 7/1988 | |
| DE | 4310440 | A1 * | 2/1994 | H01R 25/16 |
| GB | 2219443 | A | 12/1989 | |
| JP | H105259603 | A | 10/1993 | |
| JP | H0918109 | A | 1/1997 | |
| WO | 2004034748 | A1 | 4/2004 | |

OTHER PUBLICATIONS

English abstract of DE 3700661 A1 of Jul. 21, 1988.

International Search Report issued in the corresponding PCT application No. PCT/EP2012/075748, dated Mar. 27, 2013.

Chinese Office Action based on Application No. 201210006329.X(8 Pages) dated Dec. 21, 2015 (Reference Purpose Only).

* cited by examiner

CONNECTOR, ELECTRONIC DEVICE AND ILLUMINATING DEVICE HAVING THE CONNECTOR

RELATED APPLICATIONS

The present application is a national stage entry according to 35 U.S.C. §371 of PCT application No.: PCT/EP2012/075748 filed on Dec. 17, 2012, which claims priority from Chinese application No.: 201210006329.X filed on Jan. 10, 2012, and is incorporated herein by reference in its entirety.

TECHNICAL FIELD

Various embodiments relate to a connector for electronic device, an electronic device having the connector and an illuminating device configured to include the electronic device.

BACKGROUND

With the development of science and technology, various electronic devices become an indispensable part in people's life. A common electronic device, particularly a high-power electronic device, comprises a circuit board, a heat sink, especially a metal heat sink, for cooling the circuit board, and a driver for driving the circuit board to operate. During assembling, the circuit board and the driver need to be electrically connected so as to supply power to components on the circuit board. Moreover, for the sake of good heat dissipating effects, the circuit board and the driver also need to be insulatedly and mechanically connected, for instance, the heat sink is arranged between the circuit board and the driver.

In the related art, the circuit board and the driver often should be independently connected by using, for instance, electrical lead or electrical connector, and the heat sink is fixed on apart to be cooled by additionally using, for instance, an adhesive paste or a buckle structure. In such a traditional assembling manner, not only electrical connection and mechanical connection need to be simultaneously performed, but also the process is quite complex and costly. When the adhesive paste is used for mechanical connection, adverse influences also may be exerted on the effect of the mechanical connection due to too high temperature of the heat sink. When the mechanical connection is performed by using, for instance, the buckle structure, since the buckle structure usually cannot be re-opened, it is inconvenient for the maintenance of the electronic device.

SUMMARY

In order to solve the above problems, various embodiments provide a connector for electronic device. The electrical connection and insulated mechanical connection can be simultaneously realized by using the connector; moreover, the connector has a simple structure and is easily installed and disassembled.

A connector for electronic device is provided according to the present disclosure, including a cylindrical body and an end cap formed at one end of the cylindrical body that includes a first section and a second section, wherein the first section is formed between the end cap and the second section, the end cap has a diameter bigger than that of the first section, and the first section has a diameter bigger than that of the second section, and a circumferential wall of the second section at least partially has threads, and the connector further includes an insulator circumferentially formed in one piece on the first section, the end cap includes a first electrical contact surface on an end surface facing the first section, and the first section includes a second electrical contact surface on an end surface facing the second section.

The concept of the present disclosure lies in using the conductivity and the thread structure of the connector often made of a metal to simultaneously realize the electrical connection and the mechanical connection. By taking the insulation requirement in mechanical connection into particular consideration, the connector further has the insulator formed in one piece. The insulator merely encloses the first section in a circumferential direction to assure the insulation property of the first section, and also assure two end surfaces of the connector, as the first and second electrical contact surfaces, not to be covered by the insulator. The connector configured in such a manner, when making connection in an electronic device, can electrically connect two electronic parts to be connected by using the first and second electrical contact surfaces; moreover, by means of the insulator, the electrical insulation is realized with other electronic parts that need no electrical connection.

Therefore, a reliable electrical connection and mechanical connection is guaranteed in the electronic device.

In various embodiments, the insulator is molded on the first section through an insert-injection technology. Thus, the insulator and the connector are formed in one piece. The insulator and the connector also can be fabricated in one piece through injection molding or other similar technologies.

In various embodiments, the end cap has an annular flange radially separated from the first section, and an end surface of the annular flange facing the first section is the first electrical contact surface. The size of the interval between the annular flange and the first section is designed to match a position of a region to be contacted of the circuit board. Accordingly, the first electrical contact surface can be enabled to precisely electrically contact a predetermined region of parts in need of electrical connection, such as a connecting region of the circuit board. In another embodiment, the end cap also may not have the annular flange radially separated from the cylindrical body, and the insulator is merely against part of region of a lower surface of the end cap, and the other regions of the lower surface of the end cap are configured to be the first electrical contact surface.

In various embodiments, the annular flange and the first section define an annular accommodating cavity, in which one end of the insulator is accommodated fitly. As a result, it is assured that only the first electrical contact surface of the connector contacts the connecting region of parts in need of electrical connection, but the first section and the connecting region are electrically insulated.

In various embodiments, a first end surface of the insulator close to the end cap and the first electrical contact surface are in same level. Preferably, the second end surface of the insulator away from the end cap and the second electrical contact surface are in same level. Such configuration simplifies the fabrication and installation of the connector.

In various embodiments, the cylindrical body and the end cap are made of a conductive material. Preferably, the cylindrical body and the end cap are made of copper. Of course, the cylindrical body and the end cap also can be made of other materials such as Al that have favorable conductive performances.

In addition, various embodiments further provide an electronic device including at least one connector described above, and including a circuit board, a driver housing accommodating a driver and a heat sink.

In various embodiments, the connector connects the circuit board, the heat sink, the driver and the driver housing in sequence, wherein a first section of the connector enclosed by an insulator extends through the heat sink, a first electrical contact surface of the connector and the circuit board are electrically connected, a second electrical contact surface of the connector and the driver are electrically connected, and the second section is inserted into the driver housing. On one hand, the connector electrically connects the circuit board and the driver by using the first and second electrical contact surfaces; and on the other hand, in order to avoid risks, such as short circuit, of the connector and the heat sink in a fixed state, due to electrical contact, part of the connector with the insulator, i.e., the first section circumferentially enclosed by the insulator, particularly runs through the region where the electrical contact is not needed. Therefore, the connector simply and releasably mechanically connects the heat sink and the driver housing together.

Various embodiments provide an illuminating device including the electronic device of the above type and a light source, wherein the light source is installed on a circuit board of the electronic device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments.

In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
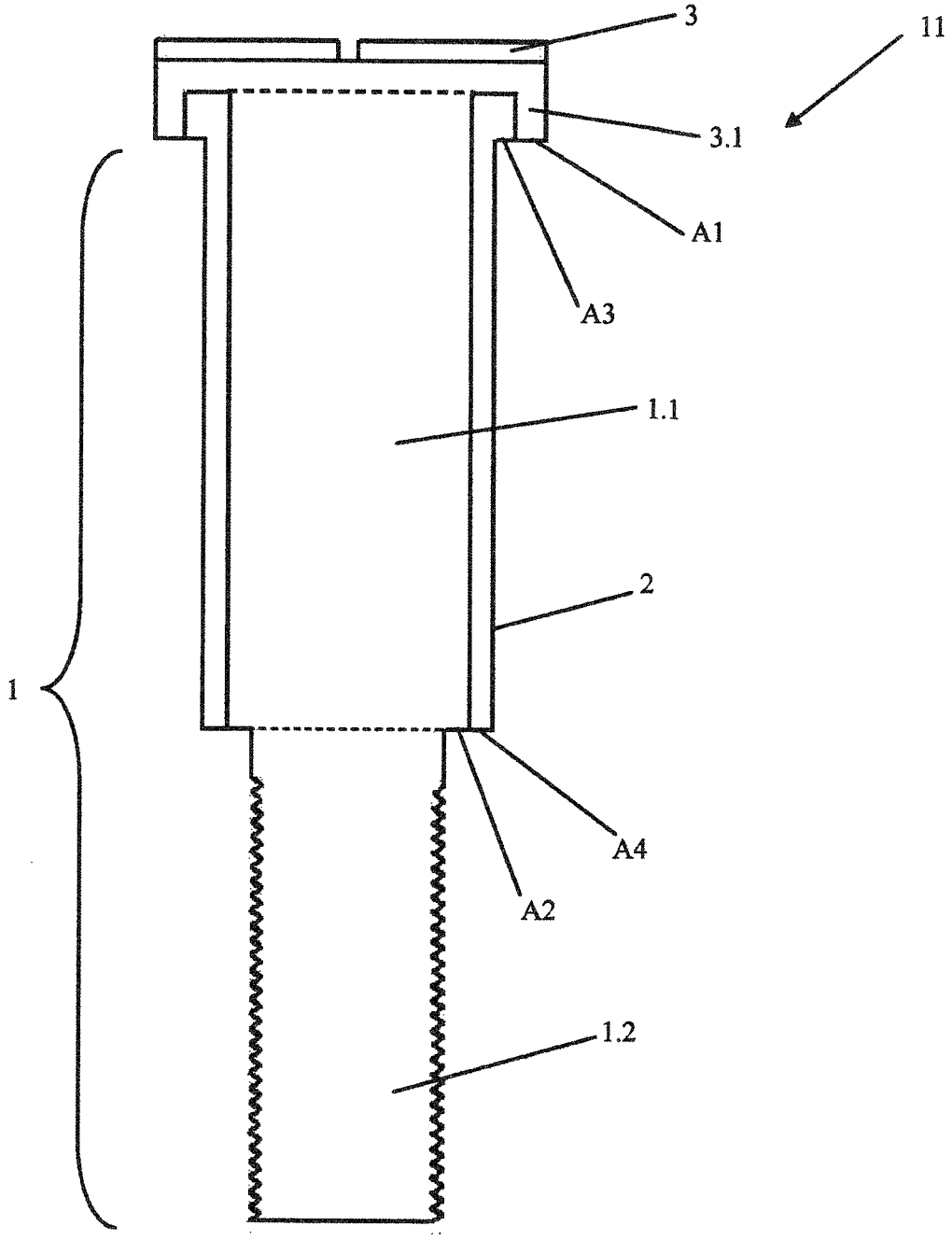
FIG. 1 is a side view of a connector of the present disclosure.

FIG. 1 is a side view of a connector of the present disclosure.

A connector 11, configured to be installed in an electronic device, has both the mechanical connecting function of the traditional connector and the function of electrically connecting two electronic parts. The connector 11 has a profile similar to a bolt, that is, the connector 11 has an end cap 3 and a cylindrical body 1. The cylindrical body 1 consists of a first section 1.1 and a second section 1.2. The first section 1.1 is formed between the end cap 3 and the second section 1.2, the end cap 3 has a diameter bigger than that of the first section 1.1, and the first section 1.1 has a diameter bigger than that of the second section 1.2. Besides, the connector 11 further has an insulator 2 formed circumferentially in one piece on the first section 1.1.

As the diameters of respective sections of the connector 11 are reduced in sequence, an end surface of the end cap 3 facing the first section 1.1 is a first electrical contact surface A1, and an end surface connecting the first section 1.1 and the second section 1.2 is a second electrical contact surface A2. By contacting the first and second electrical contact surfaces A1, A2 with different electronic parts, respectively, a reliable electrical connection between the electronic parts can be realized. Moreover, the insulator 2 assures the first section 1.1 that can be conductive not to electrically contact the electronic parts. Besides, a circumferential wall of the second section 1.2 at least partially has threads so as to realize a mechanical connecting function similar to that of the bolt.

In one preferred embodiment, the first electrical contact surface A1 can be located in the same plane as a top surface of the insulator 2 facing the end cap 3. In the embodiment shown in FIG. 1, the end cap 3 preferably has an annular flange 3.1 separated radially from the first section 1.1, and an end surface of the annular flange 3.1 facing the first section 1.1 is the first electrical contact surface A1. An annular accommodating cavity is defined between the annular flange 3.1 and the first section 1.1 so that one end of the insulator 2 is accommodated fitly in the accommodating cavity. The first electrical contact surface A1 is the end surface of the annular flange 3.1, which is favorable for precisely contacting the first electrical contact surface A1 with a connecting region on parts in need of the electrical connection, and the first section 1.1 and this connecting region are electrically separated. In addition, an end surface connecting the first section 1.1 to the second section 1.2 is used as the second electrical contact surface A2 in the present embodiment. For the sake of convenient fabrication and installation, the first electrical contact surface A1 and a first end surface A3 of the insulator 2 extending beyond the accommodating cavity are configured to be in same level, and the second electrical contact surface A2 and a second end surface A4 of the insulator are in same level.

In the connector 11 of the present disclosure, the insulator 2 can be molded in one piece with the first section 1.1 through technologies such as insertion-injection or injection molding.

Figure 2:
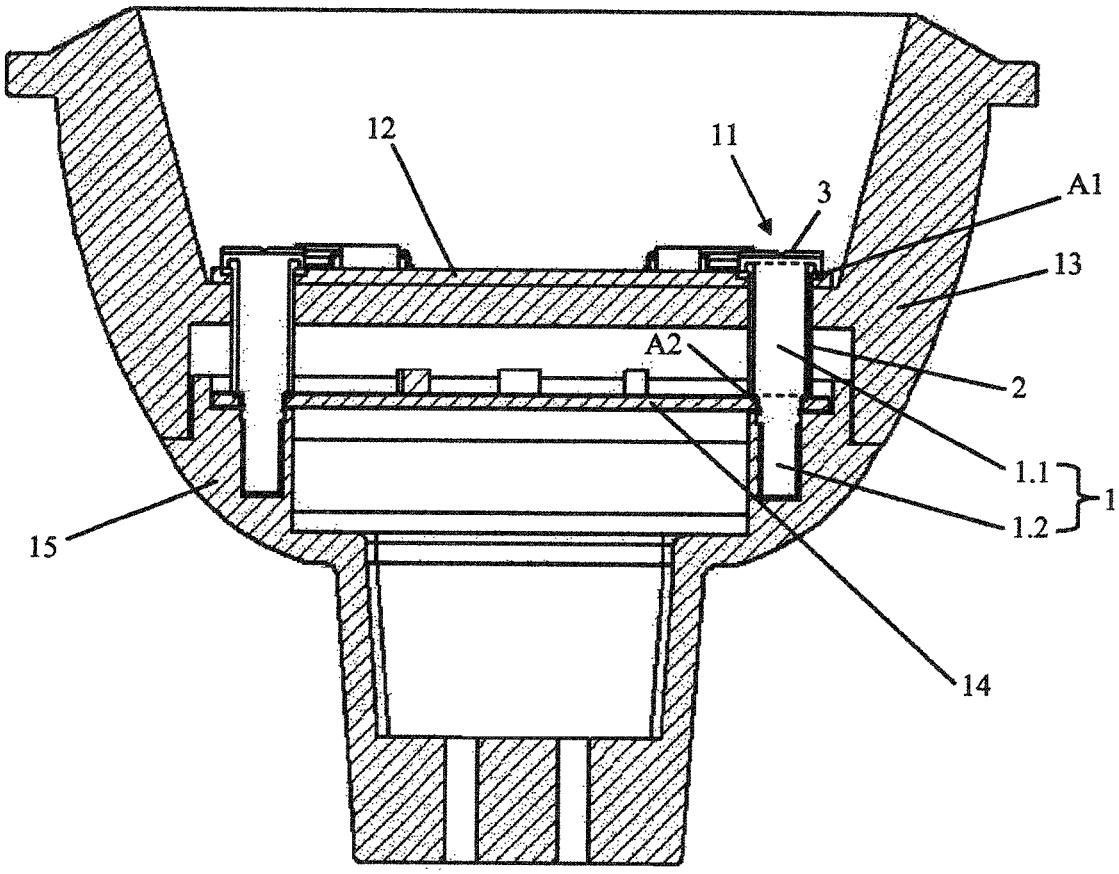
FIG. 2 is a sectional view of an illuminating device of the present disclosure.

FIG. 2 is a sectional view of an illuminating device of the present disclosure. The illuminating device comprises a circuit board 12, a heat sink 13, a driver 14, a driver housing 15 and a connector 11. The connector 11 mechanically connecting the parts above together in a screwing manner; moreover, the connector 11 realizes the electrical connection between the circuit board 12 and the driver 14 by using first and second electrical contact surfaces A1, A2.

It can be seen clearly from FIG. 2 that in a connection state, a first section 1.2 of the connector 11 is at least partially fixed in the driver housing 15. A first section of the connector 11 enclosed by an insulator 2 extends through the heat sink 13; the first electrical contact surface A1, i.e. annular end surface of an end cap 3 facing the first section 1.1 contacts a connecting region of the circuit board 12; the second electrical contact surface A2, i.e. an end surface connecting the first section 1.1 and the second section 1.2 contacts a connecting region of the driver 14. Therefore, the connector 11 merely electrically connects the circuit board 12 and the driver 14, and by means of the insulator 2, it is assured that a conductive portion of the connector 11 will not electrically contact the heat sink 13, thereby the short circuit is avoided.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 cylindrical body
1.1 first section
1.2 second section
2 insulator
3 end cap
11 connector
12 circuit board

13 heat sink
14 driver
15 driver housing
A1 first electrical contact surface
A2 second electrical contact surface
A3 first end surface
A4 second end surface

The invention claimed is:

1. A connector for electronic device, comprising:

a cylindrical body, an end cap formed at one end of the cylindrical body that comprises a first section and a second section, wherein the first section is formed between the end cap and the second section, the end cap has a diameter bigger than that of the first section, and the first section has a diameter bigger than that of the second section, and a circumferential wall of the second section at least partially has threads, and an insulator circumferentially formed in one piece on the first section, wherein the end cap comprises a first electrical contact surface on an end surface of the end cap facing the first section, and the first section comprises a second electrical contact surface on an end surface of the first section facing the second section, and the first electrical contact surface and the second electrical contact surface are insulated from the first section by the insulator.

2. The connector according to claim 1, wherein the insulator is molded on the first section through an insert-injection technology.

3. The connector according to claim 1, wherein the end cap has an annular flange radially separated from the first section, and an end surface of the annular flange facing the first section is the first electrical contact surface.

4. The connector according to claim 3, wherein the annular flange and the first section define an annular accommodating cavity, in which one end of the insulator is accommodated fitly.

5. The connector according to claim 4, wherein a first end surface of the insulator close to the end cap and the first electrical contact surface are in same level.

6. The connector according to claim 4, wherein a second end surface of the insulator away from the end cap and the second electrical contact surface are in same level.

7. The connector according to claim 1, wherein the cylindrical body and the end cap are made of a conductive material.

8. The connector according to claim 7, wherein the cylindrical body and the end cap are made of copper.

9. An electronic device, comprising a circuit board, a driver housing accommodating a driver and a heat sink, wherein the electronic device further comprises at least one connector the connector comprising:

a cylindrical body, an end cap formed at one end of the cylindrical body that comprises a first section and a second section, wherein the first section is formed between the end cap and the second section, the end cap has a diameter bigger than that of the first section, and the first section has a diameter bigger than that of the second section, and a circumferential wall of the second section at least partially has threads, and an insulator circumferentially formed in one piece on the first section, wherein the end cap comprises a first electrical contact surface on an end surface of the end cap facing the first section, and the first section comprises a second electrical contact surface on an end surface of the first section facing the second section, and the first electrical contact surface and the second electrical contact surface are insulated from the first section by the insulator.

10. The electronic device according to claim 9, wherein the connector connects the circuit board, the heat sink, the driver and the driver housing in sequence, wherein a first section of the connector enclosed by an insulator extends through the heat sink, a first electrical contact surface of the connector and the circuit board are electrically connected, a second electrical contact surface of the connector and the driver are electrically connected, and the second section is inserted into the driver housing.

11. An illuminating device, comprising an electronic device and a light source mounted on a circuit board, the electronic device comprising the circuit board, a driver housing accommodating a driver and a heat sink, wherein the electronic device further comprises at least one connector, the connector comprising:

a cylindrical body, an end cap formed at one end of the cylindrical body that comprises a first section and a second section, wherein the first section is formed between the end cap and the second section, the end cap has a diameter bigger than that of the first section, and the first section has a diameter bigger than that of the second section, and a circumferential wall of the second section at least partially has threads, and an insulator circumferentially formed in one piece on the first section, wherein the end cap comprises a first electrical contact surface on an end surface of the end cap facing the first section, and the first section comprises a second electrical contact surface on an end surface of the first section facing the second section, and the first electrical contact surface and the second electrical contact surface are insulated from the first section by the insulator.

* * * * *